US007104861B2

(12) United States Patent
Kanahele et al.

(10) Patent No.: US 7,104,861 B2
(45) Date of Patent: Sep. 12, 2006

(54) ARM MOUNTABLE CHILD ACTIVITY DEVICE

(76) Inventors: Gloria McCall Kanahele, 777 Harbour Isles Pl., N. Palm Beach, FL (US) 33410; Marcus C. Kanahele, 777 Harbour Isles Pl., N. Palm Beach, FL (US) 33410

( * ) Notice: Subject to any disclaimer, the term of this patent is extended or adjusted under 35 U.S.C. 154(b) by 35 days.

(21) Appl. No.: 11/061,489

(22) Filed: Feb. 17, 2005

(65) Prior Publication Data

US 2006/0183396 A1 Aug. 17, 2006

(51) Int. Cl.
*A63H 33/00* (2006.01)

(52) U.S. Cl. ..... 446/26; 446/28; 446/227

(58) Field of Classification Search ..... 446/26, 446/27, 28, 227; 224/217, 218
See application file for complete search history.

(56) References Cited

U.S. PATENT DOCUMENTS

| | | | | |
|---|---|---|---|---|
| 2,888,263 | A | 5/1959 | Ruhmann et al. | |
| 3,978,610 | A * | 9/1976 | Stubbmann | 446/227 |
| 4,723,323 | A | 2/1988 | Wright, Jr. | |
| 4,989,811 | A * | 2/1991 | Millis et al. | 248/104 |
| 5,707,031 | A | 1/1998 | Creighton-Young | |
| 5,957,515 | A | 9/1999 | Van Der Sluys | |
| 5,978,962 | A * | 11/1999 | Hamowy | 2/16 |
| 6,224,450 | B1 | 5/2001 | Norton | |
| 6,406,407 | B1 * | 6/2002 | Wiedmann et al. | 482/82 |
| D484,688 | S * | 1/2004 | Golliday | D3/226 |
| 6,860,786 | B1 * | 3/2005 | Oren et al. | 446/227 |
| 2004/0192156 | A1 * | 9/2004 | Abel | 446/26 |
| 2005/0067549 | A1 * | 3/2005 | Kintzele et al. | 248/690 |
| 2006/0054757 | A1 * | 3/2006 | Hays | 248/205.1 |

* cited by examiner

*Primary Examiner*—Nini F. Legesse
(74) *Attorney, Agent, or Firm*—McHale & Slavin PA

(57) ABSTRACT

The present invention is directed towards a portable, activity center for providing educational and entertaining toys to children; particularly towards an activity center that releasably attaches to an adult's forearm such that the free arm of the adult securely holds the child such that the child is able to safely interact with the activity center; most particularly an activity center including a rigid support member wherein one end thereof is releasably mounted to an adult's upper forearm and the opposite end can be releasably mounted to the lower forearm, gripped by the hand or attached to a stationary object.

7 Claims, 5 Drawing Sheets

ARM MOUNTABLE CHILD ACTIVITY DEVICE

FIELD OF THE INVENTION

The present invention is directed towards a portable, activity center for providing educational and entertaining toys to children; particularly towards an activity center that releasably attaches to an adult's forearm such that the free arm of the adult securely holds the child such that the child is able to safely interact with the activity center; most particularly an activity center including a rigid support member wherein one end thereof is releasably mounted to an adult's upper forearm and the opposite end can be releasably mounted to the lower forearm, gripped by the hand or attached to a stationary object.

BACKGROUND OF THE INVENTION

It is generally accepted that exposure to a multitude of visual, audio and physical stimuli during the early stages of development can enhance the learning capability of a child throughout life. Thus, numerous activity centers have been developed in order to stimulate and sharpen a developing child's physical and cognitive capacities. Typically these activity centers provide a variety of toys for visual and physical interaction specifically designed to hone the child's hand-eye coordination, range of motion, familiarity with animals, shapes, alphabet characters, numbers, and the like.

When not sleeping, small children often become easily bored or restless during lengthy plane or vehicle rides. Thus, many activity centers have been made portable and readily attach to various objects such as strollers, child carriers, car-seats, cribs, and the like to entertain and/or educate the child during such instances. However, none of the prior art teaches or suggests attachment of activity centers to the caregiver such that the child is entertained and learning while being safely held by or in close proximity to an adult. This arrangement can be especially advantageous in situations where an adult must hold the child on their lap or in close quarters for extended periods of time, such as on a plane, automobile car seat, train, boat, in a restaurant, and the like.

DESCRIPTION OF THE PRIOR ART

Many patents have been directed toward portable activity centers having a variety of educational/amusement devices or toys for removable attachment to various objects.

For example, U.S. Pat. No. 6,224,450 B1 to Norton discloses an activity belt worn by a cyclist and having amusement devices attached thereto to entertain a child sitting behind the cyclist. The belt has clips that allow the toys to be clipped thereto.

U.S. Pat. No. 5,957,515 to Van Der Sluys teaches an infant toy assistance device. The device comprises two loops for engaging a toy, a hand strap connected to both loops and a wrist strap. The wrist straps keeps the toy positioned near the infant in case it is dropped so that the infant can readily grip it again.

U.S. Pat. No. 5,707,031 to Creighton-Young is directed toward a forearm-supporting device to prop up a baby at the appropriate angle when nursing. The supporting device has a cavity formed centrally therein to accommodate a bottle or the like. It has one or two straps for detachably connecting the device to one's forearm. Unlike the present invention, this patent does not teach attaching at least one toy component thereto.

U.S. Pat. No. 4,723,323 to Wright, Jr. teaches an activity bib worn on the torso of an adult. The bib includes one or more activity means for interaction with a child facing the adult. This patent differs from the present invention in that it is mounted onto the torso of the caregiver and thus requires the child be carried by, or otherwise positioned immediately in front of the adult in order for the child to effectively interact with the various activity means. Moreover, the arm mounted activity center of the present invention differs in that can be selectively presented to the child at the adult's discretion by simply moving the adult's arm adjacent to or away from the infant.

U.S. Pat. No. 2,888,263 to Ruhmann et al teaches the use of a saddle seat, horse's head and skirt made of a flat flexible material and elastic strap for securing the toy to an adult's leg.

While the foregoing described prior art devices have advanced the art in variety of ways, there nevertheless remains a need for a portable and stimulating activity center that provides amusement to a child while being held in close proximity to a caregiver.

SUMMARY OF THE INVENTION

The instant invention provides a substantially rigid support having a one end connected by a rotation means to a first coupling means for detachably connecting the support to the upper forearm of an individual, and the other end rotatably connected by a rotation means to a second coupling means for attachment to the lower forearm, gripping by the hand or releasable attachment to a stationary object. The length of the rigid support includes at least one toy component removably and/or permanently attached thereto.

Accordingly, the principal objective of the present invention is to provide an arm mountable activity center for supporting and/or supplying toys designed to entertain and educate a child while being securely held by an adult.

It is another objective of the instant invention to teach a portable activity center that readily attaches to an adult and allows the adult to readily interact with the child.

An additional objective of the present invention is to teach an activity center which can be releasably attached at one end to a stationary object (e.g. table, bench, etc) thereby allowing the adult the use of both hands.

It is a further objective of the instant invention to teach an activity center that can be re-configured to present different themes (e.g. animal safari, barn yard animals, sea animals), images (e.g. shapes, colors, etc), numbers, alphabet and the like to an infant or child.

It is yet another objective of the instant invention to provide an activity centers which can attach to any size forearm.

It is still a further objective of the instant invention to teach an activity center that can be selectively presented to the child by simply moving the arm of the adult in proximity to or away from the infant.

Other objects and advantages of this invention will become apparent from the following description, wherein are set forth, by way of illustration and example, certain embodiments of this invention.

DETAILED DESCRIPTION OF THE INVENTION

As used herein, the term "infant" and "child" are synonymous and used interchangeably herein to denote a developmentally immature person.

The term "adult" and "caregiver" are use interchangeably herein to denote any person providing care and assistance to a child.

Detailed embodiments of the instant invention are disclosed herein, however, it is to be understood that the disclosed embodiments are merely exemplary of the invention, and may be embodied in various forms. Therefore, the specific functional and structural details disclosed herein are not to be interpreted as limiting, but merely as a basis for the claims and as a representative basis for teaching one skilled in the art to variously employ the present invention in virtually any appropriately detailed structure.

Figure 1:
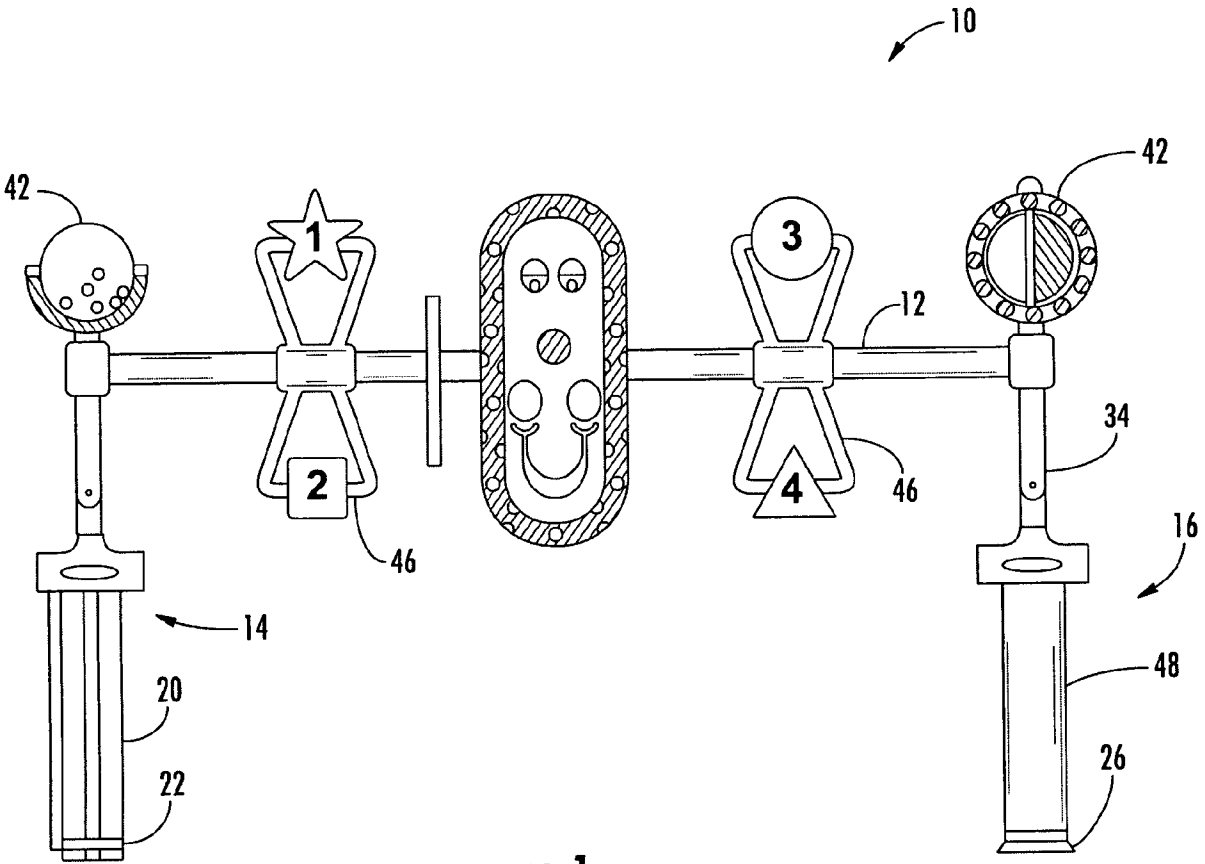
FIG. 1 is a plan view of one embodiment of the activity center of a preferred embodiment of the instant invention.

Referring now to FIGS. 1–5, wherein like members are number consistently throughout, FIG. 1 shows an example of one embodiment of an activity center of the instant invention, generally referenced as 10. In this embodiment, the activity center 10 comprises a substantially rigid support 12 having a proximal end rotatably connected about a pivot to at least one first arm coupling means 14 for removable attachment to the upper forearm of an individual, and a distal end rotatably connected about a pivot to a gripping means 18 for grasping by the adult's hand.

In the preferred embodiment shown in FIG. 1, the arm coupling means comprises two straps of a sufficient length, with one strap 20 comprising a length adjusting means, (i.e. buckle) 22 and another strap 20 of sufficient size for threading therethrough. Alternatively, each of the two straps 20 could comprise hook and pile portions (also known as VELCO®), or "parachute" clips attached thereto. For "parachute" clip and buckle attachments the length adjustment is provided by adjusting the length of the straps attached to the clips to fit to any size forearm. Hook and pile fasteners can be attached at any point to provide adjustable, yet firm contact around various sized forearms.

Figure 2:
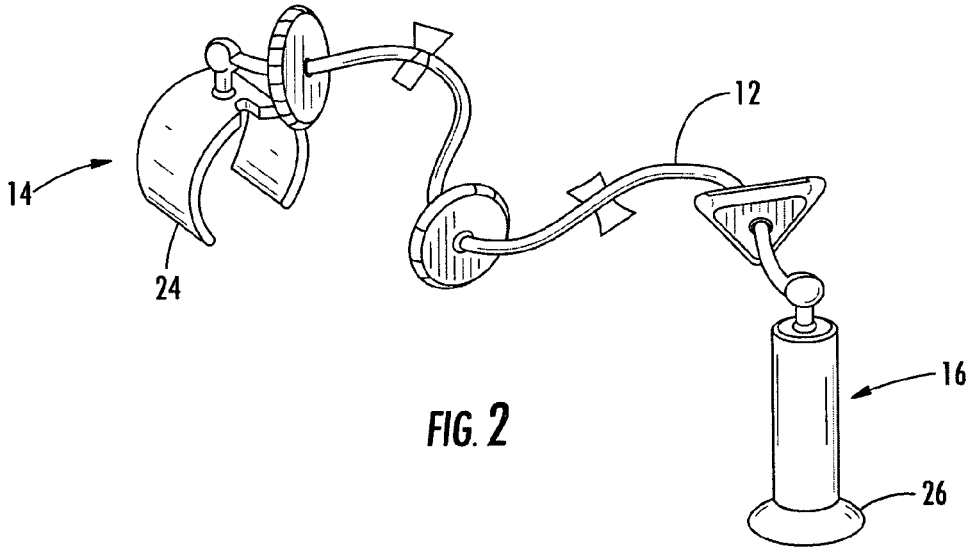
FIG. 2 is a top plan view of alternative embodiment of the activity center of the instant invention.
Figure 4:
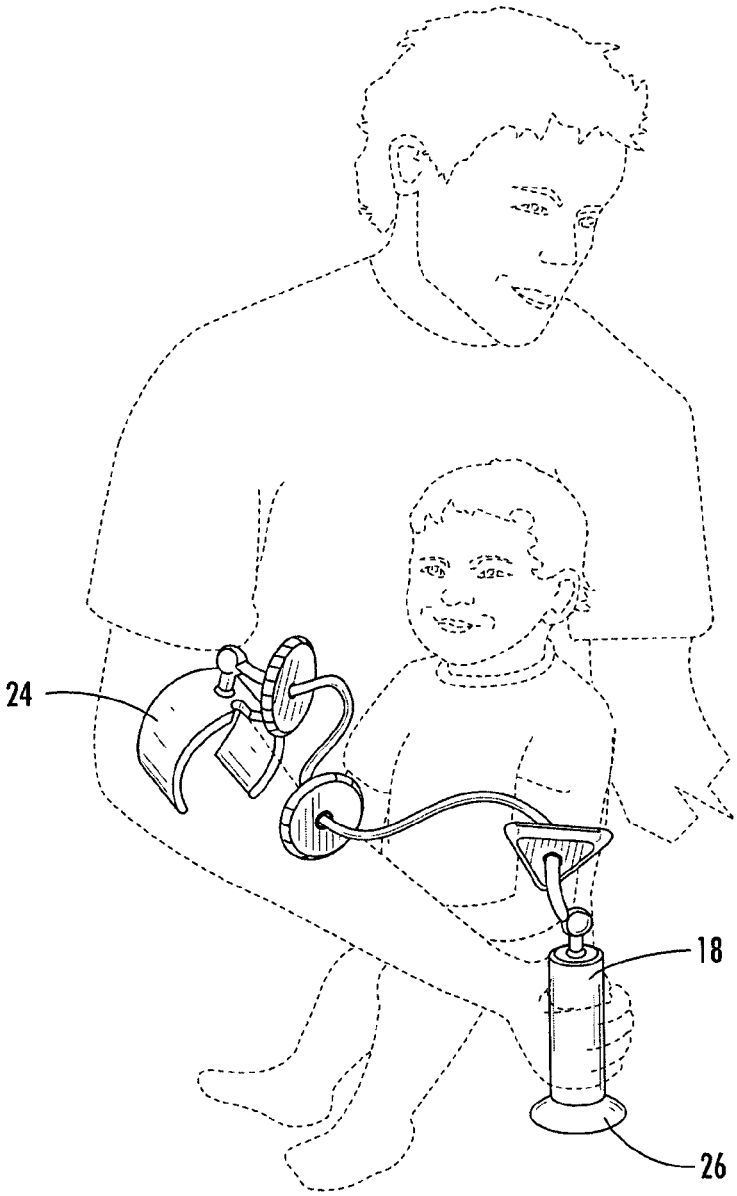
FIG. 4 is a upper perspective view of the embodiment of FIG. 2 wherein the gripping mean is being grasped by the individual.

In an alternative embodiment shown in FIGS. 2 and 4, the first arm coupling means 14 is a thin, resilient "C" shaped cuff 24. Preferably, the cuff 24 is manufactured out of a plastic material that is of such a shape and stiffness so as to allow the cuff 24 to fit most any upper forearm. It is contemplated that other coupling means for attachment to the adult or their clothing known in the art could be used, i.e. clips, snaps or and the like.

As shown in embodiments of FIGS. 1–4, the second coupling means 16 comprises a gripping means 18 sized for grasping by the average adult's hand with a longitudinal length of about 3 to about 4 inches, preferably 3.5 inches and a diameter of about 1 to 2 inches. This arrangement makes it possible to quickly release the activity center 10 so that the adult can utilize both hands if necessary. Moreover, the gripping means 18 can include a suction cup 26 attached anywhere thereto such that the distal end 16 of the activity center 10 can be releasably attached to a substantially flat vertical or horizontal surface, shown as a table top 28 in FIG. 3, which permits the adult to use both hands. Although not illustrated herein, the gripping means 18 can be constructed in any ergonomic design or material known in the art. For example, the gripping means 18 can include finger indentions (not shown) or the like.

Figure 5:
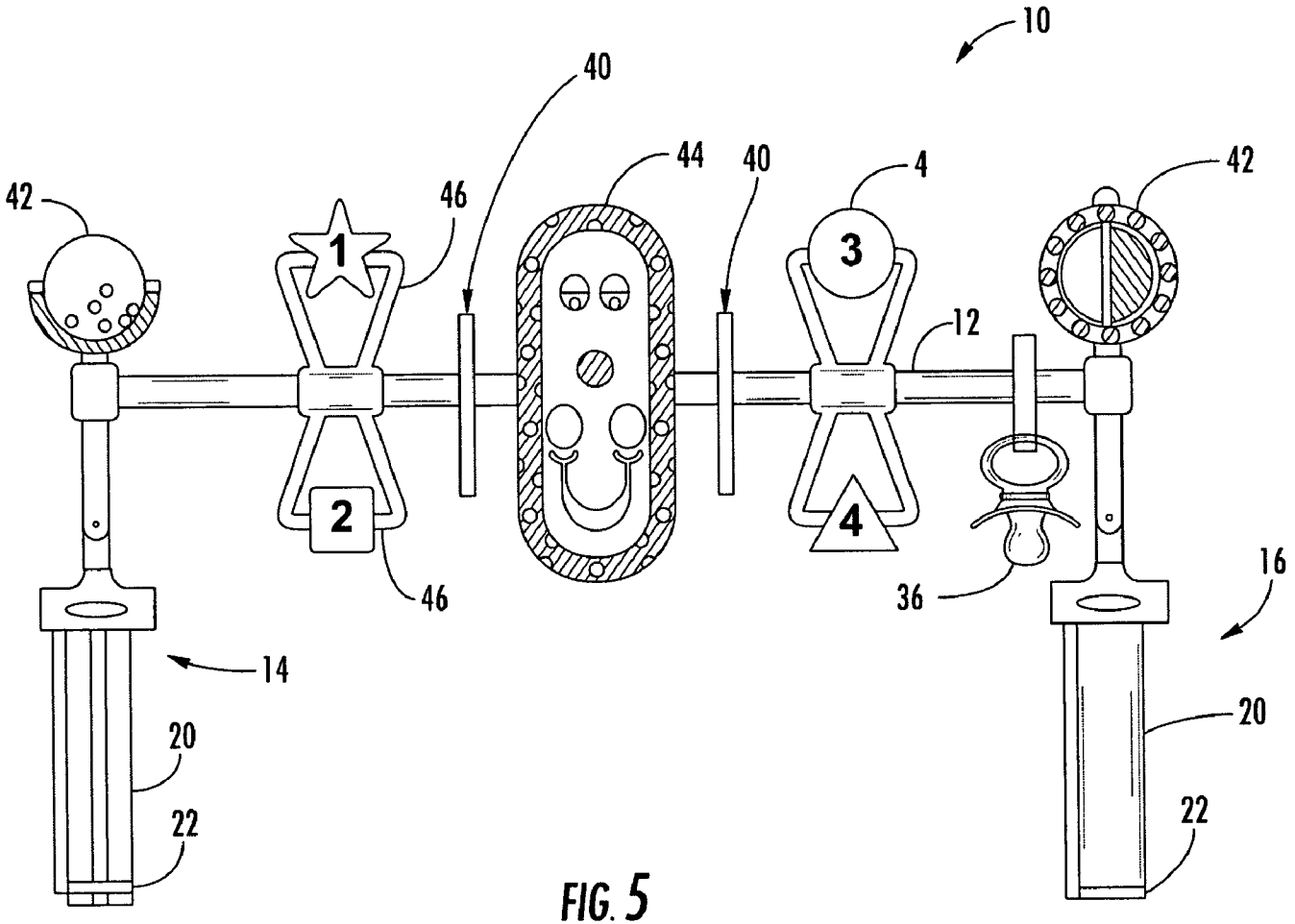
FIG. 5 is a plan view of another embodiment of the activity center of the instant invention.

Alternatively, as illustrated in FIG. 5, the second coupling means 16 that can include at least two straps in order to provide adjustable, firm contact around lower forearm or wrist. The first and second coupling 14, 16 means can include a strap 20 with buckle 22, hook and pile straps, "parachute" clips, hook and eye straps or combinations thereof in order to provide adjustable, secure attachment to a lower forearm of any size. Although not illustrated herein, the second coupling means 16 could comprise a flexible cuff of similar construction as the cuff 24 attached to the upper forearm, shown in FIGS. 2–4

The substantially rigid support member 12 of any of the aforementioned embodiments should be approximately the length of a forearm of an average adult, preferably between about 6 to about 12 inches in length. It is contemplated that the rigid support member 12 can be any color and/or shape (e.g. sinuous, straight, etc,) and manufactured from any child-safe material known in the art such that is capable of supporting at least one toy component 30 thereon. The materials utilized for the support member 12 and/or the toys 30 can employ different textures (rough, smooth, soft, etc) to stimulate the child's sense of touch.

Figure 3:
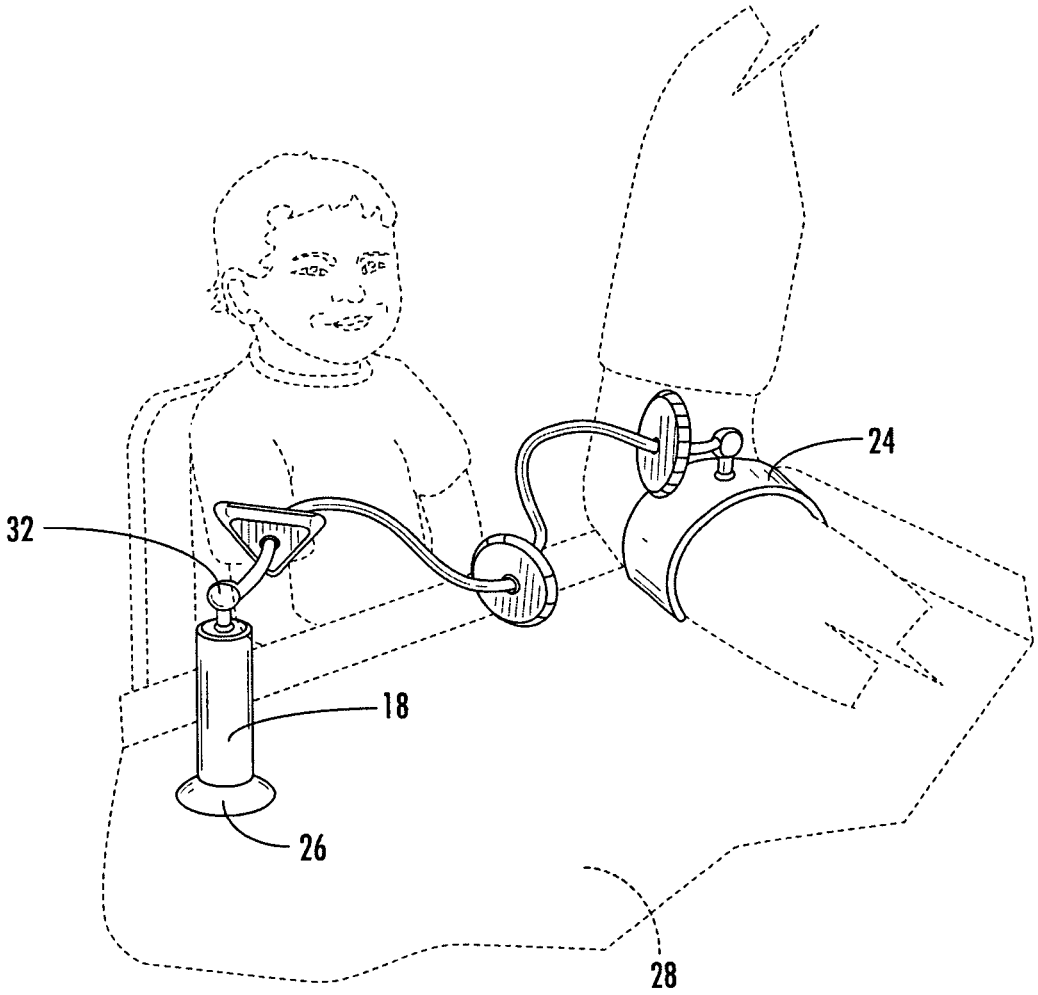
FIG. 3 is an upper perspective view of the embodiment of FIG. 2 attached to a stationary object.

The rigid support member 12 is rotatably attached to the first and second coupling means 14, 16 by any pivot or rotation means known in the art. For example, as shown in FIGS. 2–4, both the first and second coupling means 14, 16 are rotatably attached to the rigid support means 12 by a rotation means 32 (e.g. ball and socket assembly) that provides 360 degrees of rotation. As shown in FIGS. 1 and 5, the first and second coupling means 14, 16 are rotatably attached to the rigid support member 12 by a hinge 34 providing less than 360 degrees of rotation. Although not specifically illustrated herein, it is contemplated that the rigid support member could employ any combination of different rotation means as desired, e.g. a hinge 34 at one end and ball/socket assembly 32 at the other.

As would be appreciated, any of the aforementioned embodiments of the first and second coupling means 14, 16 can include a cushioned support or padding from any material which can be positioned for immediate contact with the individual's forearm, for enhanced comfort and/or preclude chafing thereto.

FIGS. 1–5, illustrate a multitude of different the toy components attached to the support member. However, it is contemplated that all or some of the toy components may be releasably attached thereto by any means known in the art, e.g. clips, VELCRO, and the like. For example, as shown in FIG. 5, a pacifier 36 may be releasably attached thereto by clips 38 for easy cleaning. Other toys could be fabricated with througholes such that upon assembly they slide onto and along a portion of the longitudinal axis of the support member 16, for instance, spinning discs 40 that are free to rotate about the longitudinal axis. In addition, some or all of the toys 30 could be attached to the rigid support member 12 so that they remain stationary relative to the longitudinal axis of the support member 12, as illustrated by the spinning ball members 42. Other toys maybe attached such that they are able to rotate about the longitudinal axis thereof, see for example the spinning clown face 44. Having these toys releasably attached to the rigid support member 12 allows for a variety of different toys selected by the caregiver to be used. This can help avoid boredom by keeping the toy components new to the infant.

Moreover, any or all of the toy components can include an electronic component that produces a sensory effect on the infant. For example at least one of the toy components can include audio generation component, visual generation component, and motor-driven component or combinations thereof known in the art. Control over the electronic components can be enabled upon actuation of sensors located on the toys and/or along portions of the rigid support member 12, such that when the infant touches a toy it responses accordingly. The electronic components can include a power supply, such as batteries or other suitable power means known in the art, securely housed within the toy components and/or activity bar 12.

Referring to FIG. 1, which illustrates an exemplary activity center 10 with an educational theme that includes toys with different numbers, shapes and colors, shapes attached to spinning trapezes 46, spinning balls 42 at both ends and an appealing child-oriented design such as colorful clown face 44 Other child-oriented designs include, albeit not limited to a sun, moon, shatter-proof mirror, or other visage for simulating hand-eye coordination and visual simulation. Additionally, the clown face 44 can contain sensors that are able to light up and play at least one nursery rhyme programmed therein when actuated.

As would be appreciated by those of ordinary skill, an unlimited number of the themes for use with the activity center are possible. Example of some, albeit not limited to, themes include: alphabets, farm animals, safari animals, sea creatures, cartoon characters, vegetables, outer space, holiday designs, biblical characters, etc.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and drawings/figures. One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An activity device for amusing and educating a child for removable attachment to an individual's arm, said activity device comprising:

a substantially rigid support having a proximal end rotatably connected by a first rotating means to an arm coupling means for removable attachment to the upper forearm of the individual, and a distal end rotatably connected by a second rotating means to a gripping means for grasping by the individual, said rigid support includes at least one toy component attached thereto;

said gripping means includes a suction cup attached thereto adapted for releasable attachment to a stationary object;

wherein said child is held by the free arm of said individual and able to interact with said at least one toy component.

2. The device as set forth in claim 1, wherein said at least one toy component further comprises at least one educational toy.

3. The device as set forth in claim 2, wherein said educational toy is at least one member selected from the group of consisting of shapes, colors, animals, alphabet characters, sea creatures, transportation means, vegetables or combinations thereof.

4. The device as set forth in claim 1, wherein said at least one first coupling means is selected from the group consisting of a flexible cuff, buckle straps, hook and eye straps, parachute clips or VELCRO straps.

5. The device as set forth in claim 1, wherein said at least one toy component is removably attached to said rigid support.

6. The device as set forth in claim 1, wherein said at least one toy component is permanently attached to said rigid support.

7. The device as set forth in claim 1, wherein said at least one toy component further comprises at least one electronic toy component.

* * * * *